US009803522B2

(12) United States Patent
Kinoshita et al.

(10) Patent No.: US 9,803,522 B2
(45) Date of Patent: Oct. 31, 2017

(54) EXHAUST STRUCTURE OF STRADDLE-TYPE VEHICLE, AND VEHICLE INCORPORATING SAME

(71) Applicant: HONDA MOTOR CO., LTD., Minato-ku, Tokyo (JP)

(72) Inventors: Ryosuke Kinoshita, Wako (JP); Soya Uchida, Wako (JP); Tatsuro Kato, Wako (JP); Shingo Arai, Wako (JP); Takatoshi Tatsumi, Wako (JP); Takaaki Kasai, Wako (JP); Hideaki Tajiri, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 15/018,378

(22) Filed: Feb. 8, 2016

(65) Prior Publication Data

US 2016/0245138 A1 Aug. 25, 2016

(30) Foreign Application Priority Data

Feb. 25, 2015 (JP) ..... 2015-034931

(51) Int. Cl.

| | |
|---|---|
| ***F01N 1/02*** | (2006.01) |
| ***F01N 1/24*** | (2006.01) |
| ***F01N 1/00*** | (2006.01) |

(52) U.S. Cl.

CPC ..... *F01N 1/24* (2013.01); *F01N 1/003* (2013.01); *F01N 1/02* (2013.01); *F01N 1/023* (2013.01); *F01N 2590/04* (2013.01)

(58) Field of Classification Search

CPC ... F01N 1/24; F01N 1/003; F01N 1/02; F01N 1/023; F01N 13/14; F01N 13/141; F01N 13/1838; F01N 2590/04

(Continued)

(56) References Cited

U.S. PATENT DOCUMENTS 1,821,688 A * 9/1931 Bourne ..... F01N 1/02 181/264
3,127,951 A * 4/1964 Pierce ..... F01N 1/02 181/245

(Continued)

FOREIGN PATENT DOCUMENTS

DE 102012221963 A1 * 8/2013 ..... B62J 23/00
JP 61079815 A * 4/1986

(Continued)

*Primary Examiner* — Edgardo San Martin
(74) *Attorney, Agent, or Firm* — Carrier Blackman & Associates, P.C.; Joseph P. Carrier; Jingli Wang

(57) ABSTRACT

An exhaust structure for a straddle-type vehicle includes a muffler having an outer tube constituting an outer circumferential member of the muffler; first and second separators defining expansion chambers in the outer tube; a body end member arranged at the downstream end of the outer tube; and glass wool provided on the inner circumference of the outer tube. The muffler further includes a resonator chamber provided in the most downstream portion of the muffler. The resonator chamber is formed by the outer tube, the body end member and the second separator situated closest to the body end member. The surroundings of the resonator chamber are surrounded by the glass wool. Such exhaust structure of a straddle-type vehicle is capable of taking measures against exhaust heat and exhaust sound even with a configuration where there is only one, single resonator chamber.

20 Claims, 10 Drawing Sheets

(58) Field of Classification Search
USPC ..... 181/256, 252, 227, 228, 272, 264, 282
See application file for complete search history.

(56) References Cited

U.S. PATENT DOCUMENTS 4,192,402 A * 3/1980 Nakagawa ..... F01N 1/04 181/256
4,598,790 A * 7/1986 Uesugi ..... F01N 1/10 181/252
5,627,351 A * 5/1997 Okuma ..... F01N 1/08 181/228
5,907,135 A * 5/1999 Hayakawa ..... F01N 1/02 181/272
5,969,299 A * 10/1999 Yamaguchi ..... F01N 1/089 181/227
6,070,695 A * 6/2000 Ohtaka ..... F01N 1/24 181/228
6,394,225 B1 * 5/2002 Yasuda ..... F01N 1/084 181/256
6,571,911 B2 * 6/2003 Watanabe ..... F01N 1/02 181/265
6,968,922 B2 * 11/2005 Kawamata ..... F01N 1/083 181/231
7,374,016 B2 * 5/2008 Yamaguchi ..... F01N 1/084 181/227
7,624,842 B2 * 12/2009 Mizutani ..... F01N 1/02 181/212
7,775,321 B2 * 8/2010 Hirukawa ..... F01N 1/084 181/227
7,779,963 B2 * 8/2010 Muto ..... F01N 1/003 180/296
7,997,383 B2 * 8/2011 Sakurai ..... F01N 1/003 181/227
8,016,071 B1 * 9/2011 Martinus ..... F04B 39/0061 181/268
8,602,158 B2 * 12/2013 Hayama ..... F01N 13/14 181/212
8,695,754 B2 * 4/2014 Iiyama ..... F01N 13/082 181/227
9,004,224 B2 * 4/2015 Uzawa ..... F01N 13/08 181/205
9,016,427 B2 * 4/2015 Yazaki ..... B62J 23/00 180/309
2007/0181360 A1 * 8/2007 Nakayama ..... F01N 1/02 180/309

FOREIGN PATENT DOCUMENTS

JP S62-121818 A 6/1987
JP H03-67012 A 3/1991
JP H09-203310 A 8/1997
JP 2010-014027 A 1/2010
JP 2010-255514 A 11/2010

* cited by examiner

EXHAUST STRUCTURE OF STRADDLE-TYPE VEHICLE, AND VEHICLE INCORPORATING SAME

CROSS-REFERENCE TO RELATED APPLICATIONS

The present invention claims priority under 35 USC 119 based on Japanese Patent Application No. 2015-034931, filed on Feb. 25, 2015. The entire subject matter of this priority document, including specification claims and drawings thereof, is incorporated by reference herein.

BACKGROUND OF THE INVENTION

1. Field of the Invention

The present invention relates to an exhaust structure of a straddle-type vehicle equipped with a resonator chamber, and to a vehicle incorporating the same. More particularly, the present invention relates to an exhaust structure including a muffler having a single resonator chamber, and to a vehicle incorporating the same.

2. Description of the Background Art

For mufflers of straddle-type vehicles such as motorcycles, techniques of providing resonator chambers next to a final expansion chamber in a muffler and of disposing glass wool between an inner body and an outer body are disclosed. An example of such technique is disclosed in the Japanese Patent Application Publication No. 2010-255514.

A muffler disclosed in the above conventional technique has a configuration where two resonator chambers are provided in a rear part of the muffler and the rearmost resonator chamber communicates with an expansion chamber via the other resonator chamber. The rearmost resonator chamber serves to supplement the other resonator chamber and makes it possible to suppress the level of measures that should be taken against uneven burns due to the influence of exhaust heat and the volume of exhaust sound as compared to the case of a single resonator chamber, and no glass wool is wound around the rearmost resonator chamber.

Recently, a restriction on the length of a muffler in a front-rear direction has also been requested in terms of design quality, output characteristics, noise, fuel consumption, and the like, and thus it has been required to take sufficient measures against uneven burns and noise even in the case where there is only one resonator chamber.

The present invention has been made in view of the aforementioned circumstances. Accordingly, it is one of the objects of the present invention to provide an exhaust structure of a straddle-type vehicle capable of taking measures against exhaust heat and exhaust sound even with a configuration where there is only one resonator chamber.

SUMMARY OF THE INVENTION

Reference numbers are included in the following description corresponding to the reference numbers used in the drawings. Such reference numbers are provided for purposes of illustration, and are not intended to limit the invention.

In order to achieve the above objects, the present invention provides an exhaust structure of a straddle-type vehicle which is configured to discharge exhaust gas from an engine (10) through an exhaust pipe (35) and a muffler (36) connected to the exhaust pipe (35) and including a resonator chamber (R3) for exhaust sound reduction. The muffler (36) includes: an outer tube (133) constituting an outer circumferential member of the muffler (36); at least one separator (151, 153) defining expansion chambers (R1, R2) in the outer tube (133); a body end member (155) being provided at a downstream end of the outer tube (133); and a noise-damping material (137) being provided on an inner circumference of the outer tube (133), the resonator chamber (R3) is provided in a most downstream part of the muffler (36) by the outer tube (133), the body end member (155), and the separator (153) being the closest to the body end member (155), and surroundings of the resonator chamber (R3) are surrounded by the noise-damping material (137).

In the above configuration, the exhaust structure may be configured so that an inner tube (135) is provided inside the outer tube (133), a space between the inner tube (135) and the outer tube (133) is filled with the noise-damping material (137), and a water-draining opening (135K) is provided in the inner tube (135) at a position located under the resonator chamber (R3).

Further, in the above configuration, the exhaust structure may be configured so that the separator (153) being the closest to the body end member (155) includes: a curve portion (153B) curving toward a front of a vehicle body; and a surface-following portion (153A) extending toward a rear of the vehicle body along the inner tube (135), and the surface-following portion (153A) is provided with a notch portion (153L) exposing the opening (135K) of the inner tube (135).

Further, in the above configuration, the exhaust structure may be configured so that the body end member (155) includes a curve portion (155B) curving toward the front of the vehicle body, and the curve portion (155B) is fitted to the inner tube (135) and covers the noise-damping material (137) in the space between the outer tube (133) and the inner tube (135).

Further, in the above configuration, the exhaust structure may be configured so that the muffler (36) includes a tail pipe (157) penetrating the separator (153) being the closest to the body end member (155) and the body end member (155), and being configured to emit the exhaust gas to outside air, and the tail pipe (157) is welded to the body end member (155), and is inserted into and supported by the separator (153).

Further, in the above configuration, the exhaust structure may be configured so that the muffler (36) includes a communicating pipe (159) disposed inside the muffler and configured to emit the exhaust gas from the exhaust pipe (35) to one of the expansion chambers (R2) that is defined by the separator (153) being the closest to the body end member (155), and the tail pipe (157) is disposed with a tilt above the communicating pipe (159).

Further, in the above configuration, the structure may be configured so that a downstream end of the muffler (36) is located ahead of a rear end of a swing arm (12) of the straddle-type vehicle, and a muffler cover (200) is provided on the muffler (36) at a position not overlapping the tail pipe (157) and the communicating pipe (159) when viewed in a side view of the vehicle body.

Effects of the Invention

According to the present invention, the muffler includes: an outer tube constituting an outer circumferential member of the muffler; at least one separator defining expansion chambers in the outer tube; a body end member being provided at a downstream end of the outer tube; and a noise-damping material being provided on an inner circumference of the outer tube, the resonator chamber is provided in a most downstream part of the muffler by the outer tube, the body end member, and the separator being the closest to the body end, and surroundings of the resonator chamber are surrounded by the noise-damping material. Thus, by using the resonator chamber lower in temperature than the expansion chambers in the muffler and the glass wool around the resonator chamber, it is possible to reduce uneven burns on the most downstream part of the muffler where uneven burns are generally likely to occur, and reduce exhaust sound.

Moreover, since a downstream part of the outer tube has a double-wall structure formed of the body end member and the separator, unwanted sound at the most downstream part of the muffler can be reduced. Accordingly, it is possible to take measures against exhaust heat and exhaust sound even with a configuration where there is only one resonator chamber.

In the above configuration, an inner tube is provided inside the outer tube, a space between the inner tube and the outer tube is filled with the noise-damping material, and a water-draining opening is provided in the inner tube at a position under the resonator chamber. Thus, moisture pooled in the resonator chamber can be drained to the space of the noise-damping material between the outer tube and the inner tube. Thereby, it is possible to avoid a situation where beads of water run on a lower surface of the muffler at a position immediately below the resonator chamber.

Further, the separator is disposed closest to the body end member includes: a curve portion curving toward a front of a vehicle body; and a surface-following portion extending toward a rear of the vehicle body along the inner tube. The surface-following portion is provided with a notch portion exposing the opening of the inner tube. Thus, the notch portion allows moisture pooled in the resonator chamber to be drained to the space of the noise-damping material without being blocked by the surface-following portion of the separator. Moreover, the volume of the resonator chamber can be easily adjusted by the curve portion of the separator.

Further, the body end member includes a curve portion curving toward the front of the vehicle body, and the curve portion is fitted to the inner tube and covers the noise-damping material in the space between the outer tube and the inner tube. Thus, it is possible to use the body end member as a lid member covering the noise-damping material, and fill the space with the noise-damping material so that it reaches the vicinity of the body end member. Accordingly, the surroundings of the resonator chamber can be extensively covered with the noise-damping material.

Further, the muffler includes a tail pipe penetrating the body end member and the separator the closest to the body end member, and being configured to emit the exhaust gas to outside air, and the tail pipe is welded to the body end member and is inserted into and supported by the separator. Thus, it is possible to stably support the tail pipe and improve the workability in attachment of the tail pipe as compared to the case where the tail pipe is supported by only one of the body end member and the separator.

Further, the muffler includes a communicating pipe disposed inside the outer tube and configured to emit the exhaust gas from the exhaust pipe to one of the expansion chambers that is defined by the separator being the closest to the body end member, and the tail pipe is disposed in a tilt manner with respect to and above the communicating pipe. Thereby, it is possible to dispose the communicating pipe and the tail pipe efficiently using upper and lower spaces in the muffler.

Further, a downstream end of the muffler is located ahead of, inwardly of a rear end of a swing arm of the straddle-type vehicle when viewed in a side view, and a muffler cover is provided in the muffler at a position not overlapping the tail pipe and the communicating pipe in a side view of the vehicle body. Thereby, it is possible to achieve a muffler cover shape less likely to retain heat from the muffler while maintaining design quality.

For a more complete understanding of the present invention, the reader is referred to the following detailed description section, which should be read in conjunction with the accompanying drawings. Throughout the following detailed description and in the drawings, like numbers refer to like parts.

BRIEF DESCRIPTION OF THE DRAWINGS

FIGS. 9A to 9D are each a sectional view of the muffler, in which FIG. 9A is a sectional view taken along a line A-A in FIG. 3, FIG. 9B is a sectional view taken along a line B-B in FIG. 3, FIG. 9C is a sectional view taken along a line C-C in FIG. 3, and FIG. 9D is a sectional view taken along a line D-D in FIG. 3.

FIGS. 10A and 10B are each a view of a muffler cover, in which FIG. 10A is a view of the muffler cover viewed from the right side of the vehicle body, and FIG. 10B is a top view of the muffler cover.

DETAILED DESCRIPTION OF ILLUSTRATIVE EMBODIMENTS

An illustrative embodiment of the present invention will be described hereinafter in detail with reference to the accompanying drawings. Throughout this description, relative terms like "upper", "lower", "above", "below", "front", "back", and the like are used in reference to a vantage point of an operator of the vehicle, seated on the driver's seat and facing forward. It should be understood that these terms are used for purposes of illustration, and are not intended to limit the invention.

Herein below, an embodiment of the present invention will be described with reference to the drawings. As noted above, directions such as front, rear, left, right, up, down in the following description are the same as those in a vehicle body unless otherwise stated. In addition, in each drawing, reference sign FR indicates the front side of the vehicle body, reference sign UP indicates the upper side of the vehicle body, and reference sign LH indicates the left side of the vehicle body.

Figure 1:
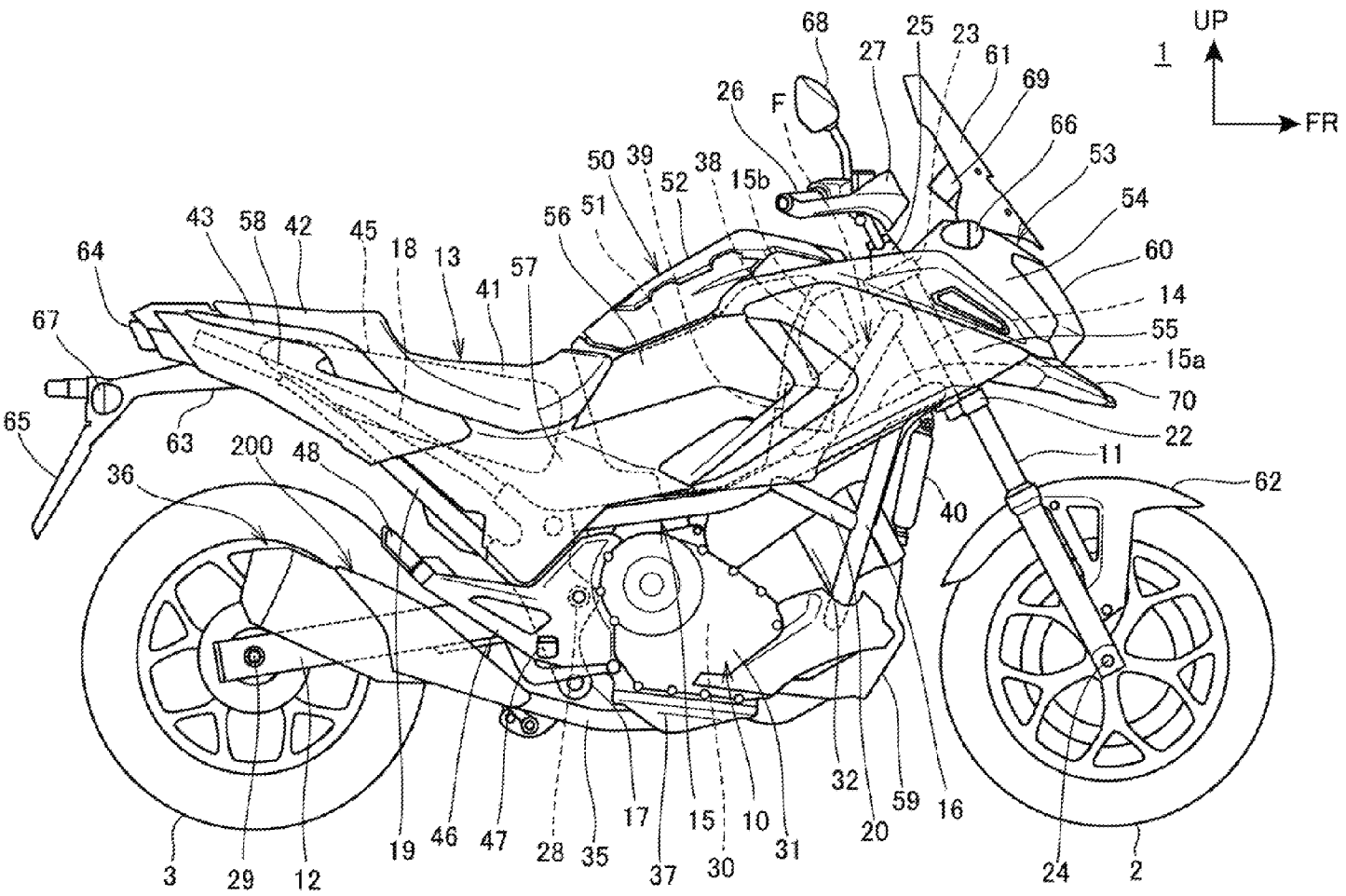
FIG. 1 is a right-side view of a motorcycle according to an embodiment of the present invention.

FIG. 1 is a right-side view of a motorcycle according to an embodiment of the present invention. It may be noted that, as to parts provided as a left and right pair, only a right-side part is illustrated in FIG. 1.

A motorcycle 1 is a vehicle in which: an engine 10 as a power unit is supported on a body frame F; a pair of left and right front forks 11, 11 supporting a front wheel 2 is steerably supported on a front end of the body frame F; and a swing arm 12 supporting a rear wheel 3 is provided on a rear side of the body frame F. The motorcycle 1 is a straddle-type vehicle in which a seat 13 that an occupant straddles and sits on is provided above a rear part of the body frame F.

The body frame F includes: a head pipe 14 provided at its front end; a pair of left and right main frames 15, 15 extending downward toward the rear from a lower part of the head pipe 14; a pair of left and right down frames 16, 16 extending rearward and downward from front end parts of the main frames 15, 15 respectively; a pair of left and right pivot frames 17, 17 extending downward from rear ends of the main frames 15, 15 respectively; a pair of left and right seat frames 18, 18 extending upward toward the rear respectively from upper ends of the pivot frames 17, 17 to a rear end part of the vehicle; and a pair of left and right subframes 19, 19 extending upward toward the rear from upper parts of the pivot frames 17, 17 to be connected to rear parts of the seat frames 18, 18 respectively.

Each main frame 15 includes: a main frame body portion 15*a* extending downward toward the rear from the lower part of the head pipe 14 with a relatively gentle slope; and a reinforcement frame portion 15*b* connecting an upper part of the head pipe 14 and an intermediate part of the main frame body portion 15*a*. In addition, the body frame F includes a pair of left and right connection frames 20, 20 connecting intermediate parts of the main frame body portions 15*a*, 15*a* and the down frames 16, 16 respectively.

A steering shaft (not illustrated) is turnably and axially supported on the head pipe 14, and a bottom bridge 22 and a top bridge 23 extending in a vehicle widthwise direction are respectively fixed at a lower end part and an upper and part of the steering shaft. The front forks 11, 11 are supported by the bottom bridge 22 and the top bridge 23, and the front wheel 2 is axially supported on a front-wheel axle 24 provided at lower ends of the front forks 11, 11. The top bridge 23 includes a handlebar holder 25 extending upward from its upper surface, and a steering handlebar 26 extending in the vehicle widthwise direction is supported on the handlebar holder 25. Knuckle guards 27, 27, rearview mirrors 68, 68, and the like are attached to the handlebar 26.

The swing arm 12 is axially supported at its front end part by a pivot shaft 28 connecting the left and right pivot frames 17, 17, and is swung vertically about the pivot shaft 28. The rear wheel 3 is axially supported on a rear-wheel axle 29 inserted in a rear end part of the swing arm 12.

A rear suspension (not illustrated) is provided between the swing arm 12 and the body frame F.

The engine 10 includes: a crankcase 31 supporting a crankshaft 30 extending in the vehicle widthwise direction; and a cylinder portion 32 extending forward and upward from a front part of the crankcase 31. The engine 10 is an engine tilting forward so that a cylinder axis C of the cylinder portion 32 may become closer to horizontal than vertical, and a component arranging space is secured above the engine 10. The power from the engine 10 is transmitted to the rear wheel 3 via a chain (not illustrated) provided between an output shaft (not illustrated) of the engine 10 and the rear wheel 3.

A single exhaust pipe 35 is connected to a front surface of the cylinder portion 32. The exhaust pipe 35 extends downward toward the front, then bends and extends rearward, and then passes under the engine 10 before being connected to a single muffler 36 (also referred to as an exhaust muffler or a silencer) disposed at a lateral side of the swing arm 12. Exhaust gas from the engine 10 is fed to the muffler 36 through the exhaust pipe 35, and is discharged to the outside (outside air) after being reduced in pressure inside the muffler 36.

In other words, the exhaust pipe 35 and the muffler 36 constitute an exhaust system of the engine 10. A catalytic converter 37 is provided along the way of the exhaust pipe 35. The catalytic converter 37 also constitutes a part of the exhaust system. Further, a muffler cover 200 is attached to the muffler 36.

An air cleaner box 38 is connected to a back surface of the cylinder portion 32 with a throttle body (not illustrated) between them. The air cleaner box 38 is disposed above the cylinder portion 32 by being disposed above front parts of the main frames 15, 15 and behind the head pipe 14. The air cleaner box 38 is configured to take in fresh air using the intake pressure of the engine 10 and clean the air with its inside filter. The air cleaned in the air cleaner box 38 is flowed downward toward the cylinder portion 32 by the intake pressure of the engine 10, and its flow rate is adjusted by the throttle body before being fed to the cylinder portion 32.

In addition, a battery 39 to supply power to each part of the vehicle body is disposed between the air cleaner box 38 and the pair of main frame body portions 15*a*. The engine 10 is a water-cooled engine, and a radiator 40 to air-cool the cooling water of the engine 10 is disposed below the head pipe 14 and ahead of the cylinder portion 32.

The seat 13 includes: a front seat 41 for the rider; and a rear seat 42 for a passenger. The rear seat is situated at a position one step higher than the front seat 41. The front seat 41 is disposed above the pivot frames 17, 17 and front parts of the seat frames 18, 18, and the rear seat 42 is disposed above the seat frames 18, 18. Grips 43, 43 for the passenger sitting on the rear seat 42 to grip are arranged at left and right sides of the rear seat 42 respectively.

A fuel tank 45 is disposed using a space below the front seat 41 and the rear seat 42 and between the seat frames 18, 18.

A pair of left and right step holders 46, 46 is arranged outside the pivot frames 17, 17 in the vehicle widthwise direction, steps 47, 47 for the rider are fixed at front parts of the respective left and right step holders 46, 46, and tandem steps 48, 48 for the passenger are fixed at rear parts of the respective left and right step holders 46, 46.

A storage box 50 is provided above a rear part of the main frames 15, 15 at a position between the front seat 41 and the head pipe 14. The storage box 50 includes a box body 51 having an opening in its upper surface; and a box lid 52 to openably and closably cover the opening in the upper surface.

The box body 51 has a capacity that can accommodate one full-face helmet. The air cleaner box 38 and the battery 39 are disposed between the box body 51 and the head pipe 14.

The motorcycle 1 includes a resin-made body cover 53 covering the vehicle body. The body cover 53 includes a front cowl 54 being a cover covering a front part of the vehicle body; a pair of left and right side covers 55, 55 covering lateral sides of the front part of the vehicle body; a pair of left and right box side covers 56, 56 covering the box body 51; a pair of left and right middle covers 57,57 covering lateral sides of a part of the vehicle body behind the side covers 55, 55; and a rear cowl 58 covering a rear part of the vehicle body behind the middle covers 57, 57.

The front cowl 54 is disposed ahead of the head pipe 14, and a headlight 60, a shield 61 (also referred to as a windshield), and a pair of left and right front indicators 66, 66 are attached to the front cowl. The side covers 55, 55 are attached to left and right parts of the front cowl 54 and laterally cover the head pipe 14 and the front parts of the main frames 15, 15.

The box side covers 56, 56 are disposed between the pair of side covers 55, 55 and the front seat 41 and laterally cover an upper part of the box body 51. The box side covers 56, 56 also serve as rider's knee grip portions. The middle covers 57, 57 are attached to the body frame F and, above the main frames 15, 15, cover a lower part of the box body 51 and a part below the front seat 41. The rear cowl 58 is attached to the seat frames 18, 18, and covers the seat frames 18, 18 and the subframes 19, 19 below the rear seat 42. A pair of taillights 64 is arranged at a rear end part of the rear cowl 58.

The body cover 53 further includes an undercover 59 covering the engine 10 from below; a front fender 62 covering an upper part of the front wheel 2; a rear fender 63 being provided above the rear wheel 3 and covering the fuel tank 45 from below; and a beaky cowl 70 projecting downward toward the front like a beak from a part below the front cowl 54. The pair of left and right taillights 64, a license plate holder 65, and a pair of rear indicators 67, 67 are attached to the rear fender 63. The beaky cowl 70 is formed so as to taper toward its front end both in a vertical direction and in the vehicle widthwise direction.

Figure 2:
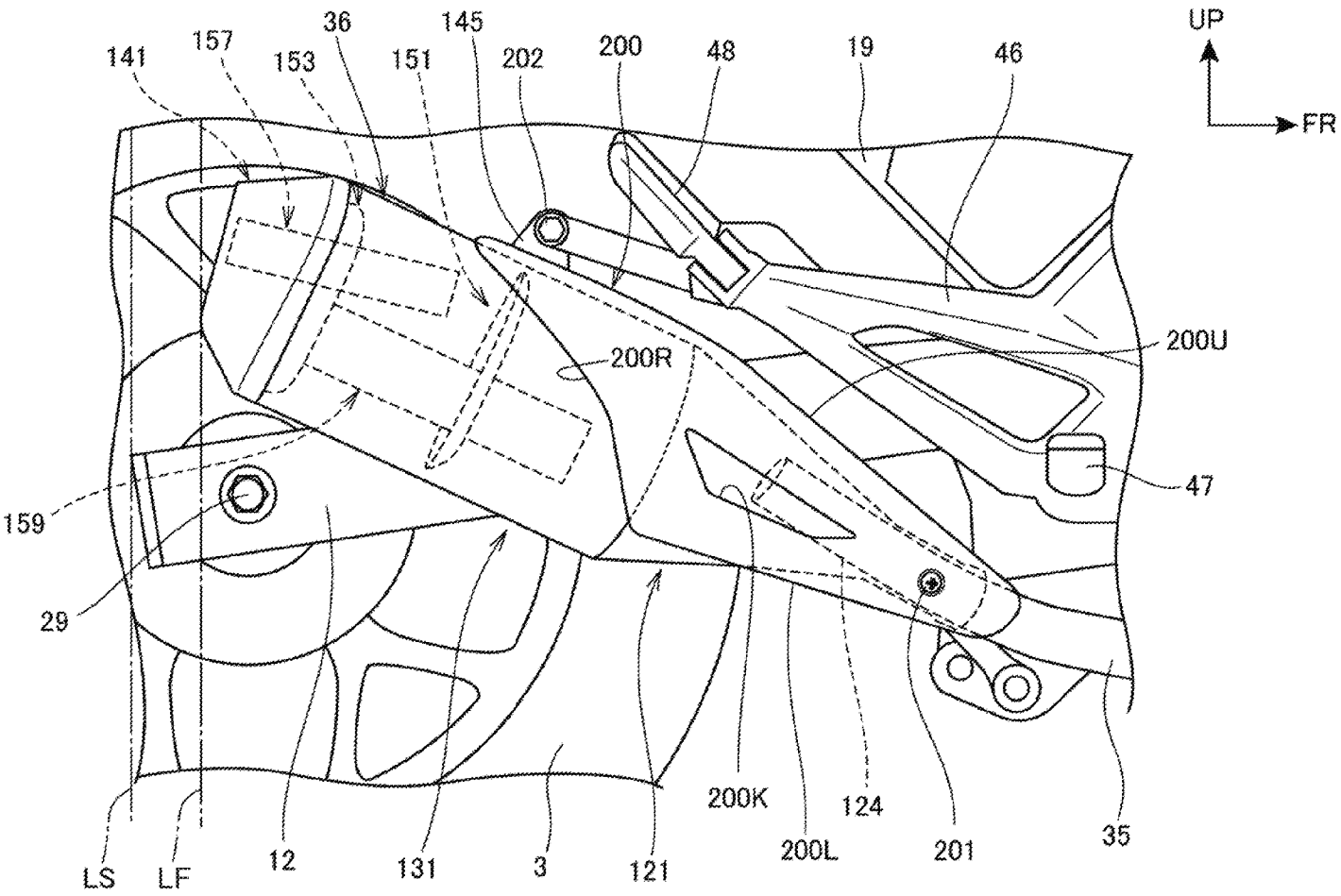
FIG. 2 is a view of a muffler of the motorcycle and its peripheral configuration viewed from the right side of a vehicle body.

FIG. 2 is a view of the muffler 36 of the motorcycle 1 and its peripheral configuration viewed from the right side of the vehicle body. As illustrated in FIG. 2, the muffler 36 is disposed in a rear lower part of the vehicle body in a space behind the pivot frames 17 and at the lateral side of the swing arm 12. A rear end position LF (see FIG. 2) being a downstream end of the muffler 36 is located ahead of a rear end position LS of the swing arm 12, more specifically, located behind the rear-wheel axle 29 and ahead of the rear end position LS of the swing arm 12. Accordingly, the muffler 36 is formed as a muffler shorter in a front-rear direction than general mufflers extending rearward of the rear end position LS of the swing arm 12. Such configuration makes it possible to locate the center of gravity of the muffler 36 closer to the center in the front-rear direction of the vehicle body, and thus easily centralize the mass of the vehicle body.

Figure 3:
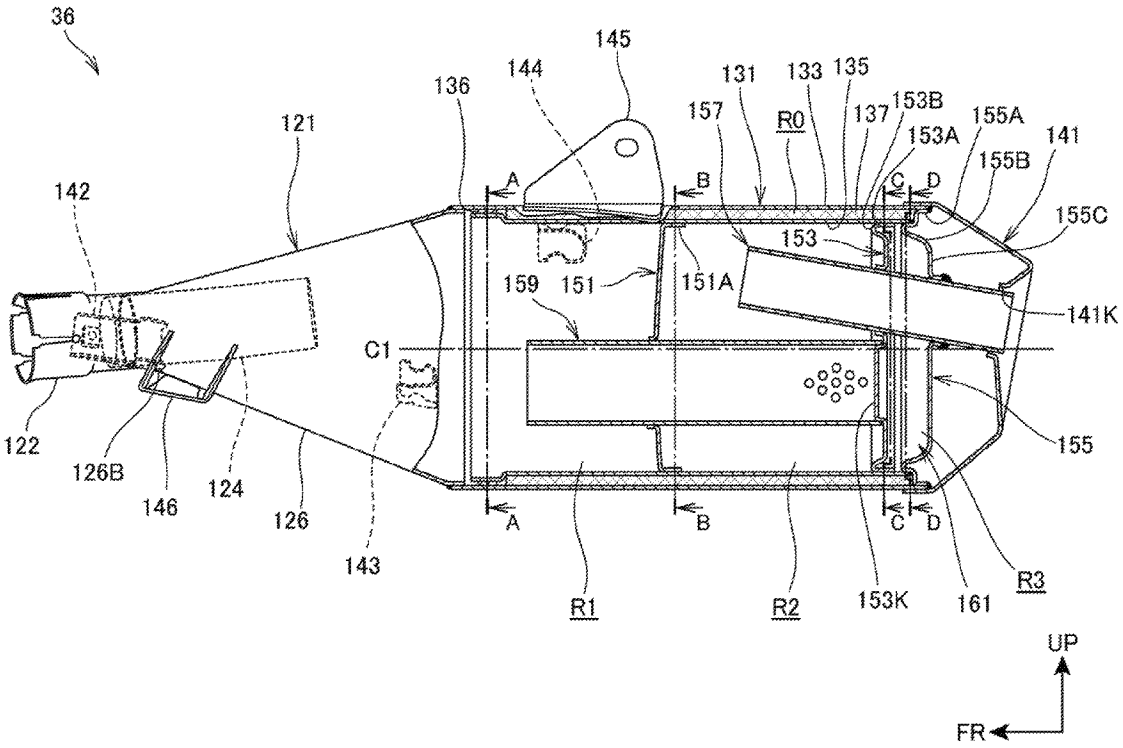
FIG. 3 is a partial sectional view of the muffler viewed from the left side of the vehicle body.
Figure 4:
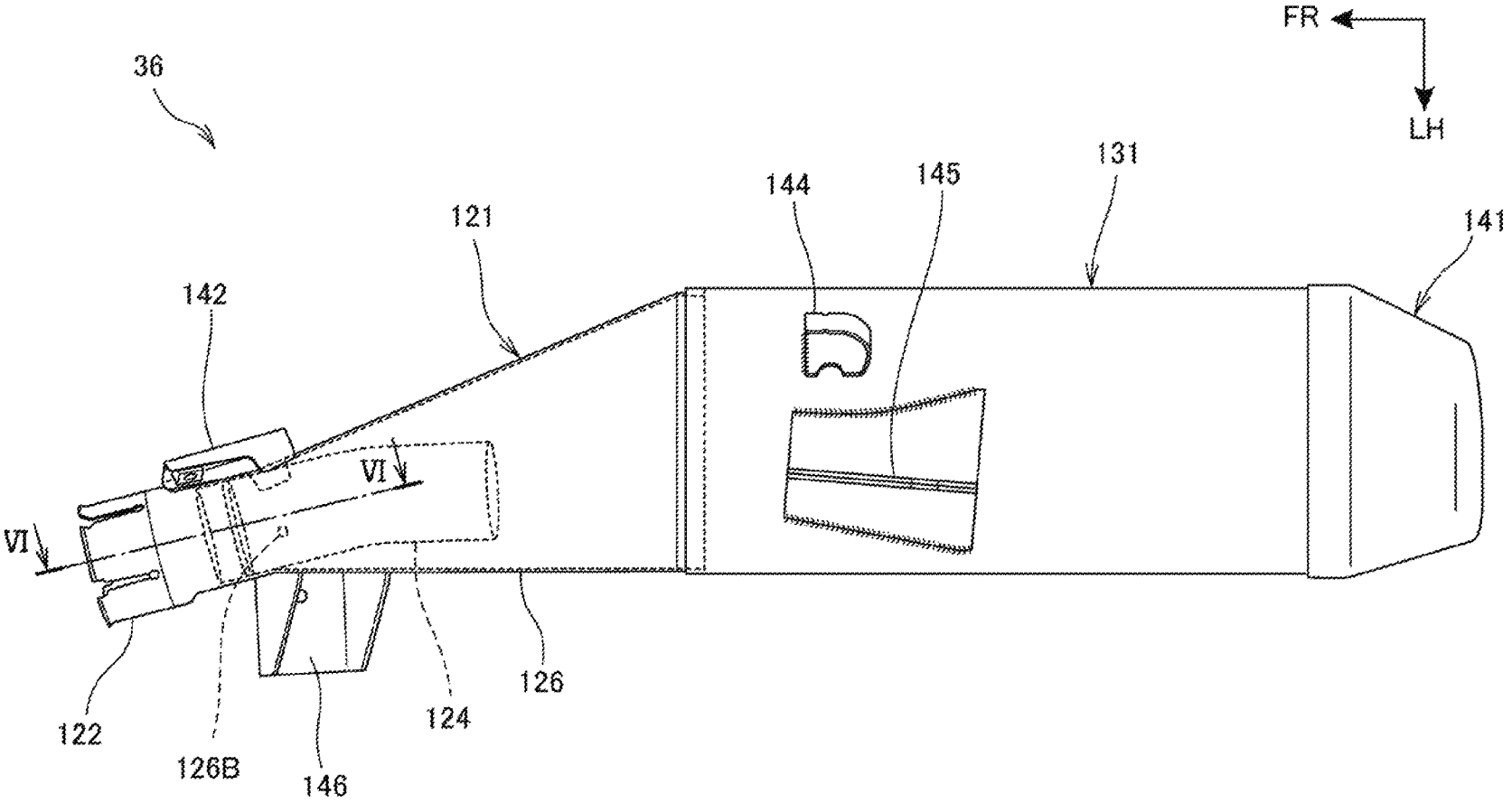
FIG. 4 is a top view of the muffler.
Figure 5:
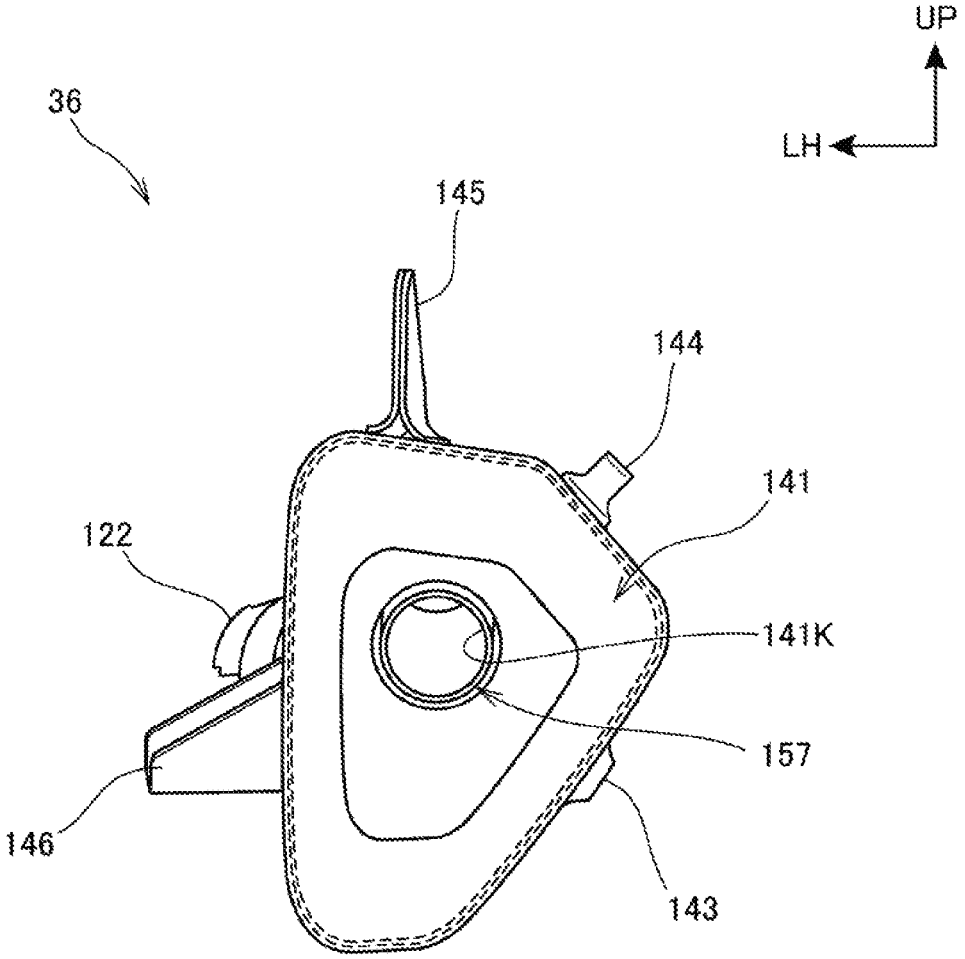
FIG. 5 is a rear view of the muffler.
Figure 6:
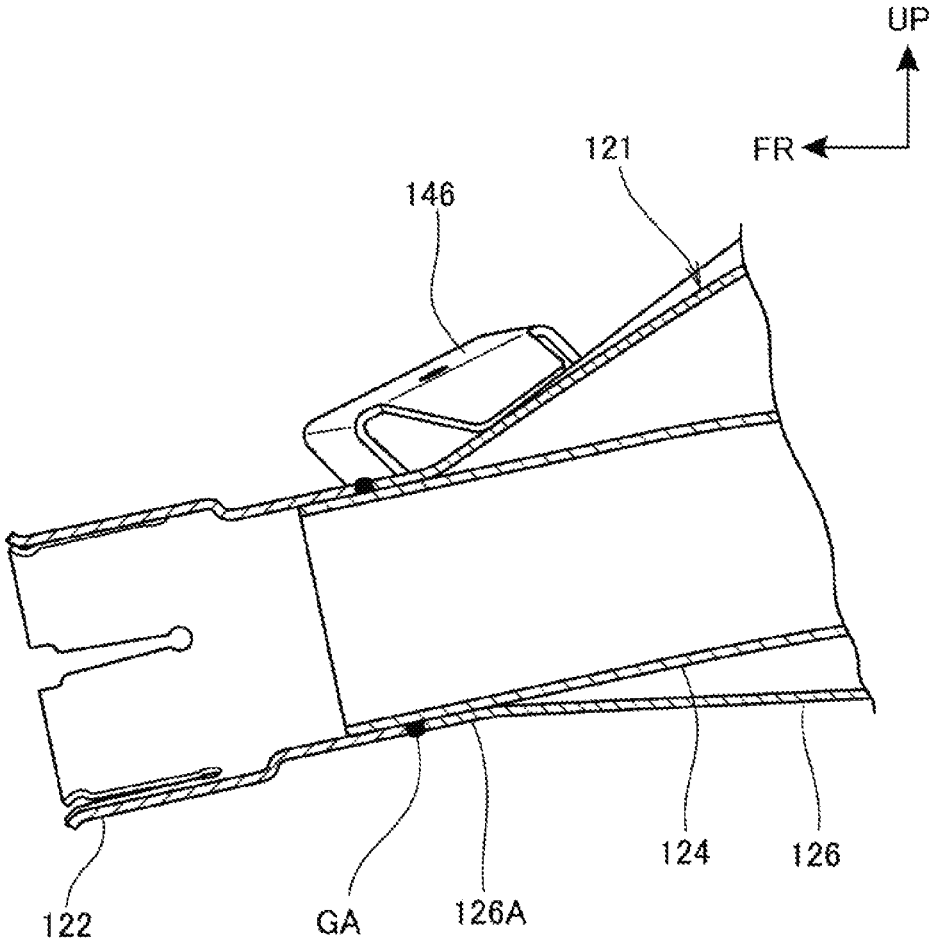
FIG. 6 is a sectional view taken along a line VI-VI in FIG. 4.

FIG. 3 is a partial sectional view of the muffler 36 viewed from the left side of the vehicle body. FIG. 4 is a top view of the muffler 36, and FIG. 5 is a rear view of the muffler 36. It may be noted that FIGS. 3 and 4 illustrate a central axis C1 of the muffler 36. FIG. 6 is a sectional view taken along a line VI-VI in FIG. 4. It may be noted that, in FIGS. 3 and 4, a front direction of the muffler 36 is indicated by reference sign FR, and an upper direction of the muffler 36 is indicated by reference sign UP.

As illustrated in FIG. 3 through FIG. 5, the muffler 36 is formed in the shape of a hollow tube. The muffler includes an upstream-side tubular body 121 connected to the exhaust pipe 35; a downstream-side tubular body 131 being connected continuously to the upstream-side tubular body 121; and a tail cap 141 covering a downstream-side opening of the downstream-side tubular body 131.

Multiple cover attachment members 142, 143, and 144 for fixing the muffler cover 200 covering a part of an outer circumferential surface of the muffler 36, a muffler stay 145 for supporting the muffler 36 on the motorcycle 1, and a stay 146 being a stand stopper that a center stand (not illustrated) of the motorcycle 1 contacts are joined to the outer circumferential surface of the muffler 36.

The multiple cover attachment members 142 to 144 are constituted of three members spaced from one another in the front-rear and vertical directions. The foremost (upstream-side) cover attachment member 142 is provided at a front end of the upstream-side tubular body 121 and outside the upstream-side tubular body in the vehicle widthwise direction, and is formed as a fastening stay to which a fastening member 201 (see FIG. 2) for fastening the muffler cover 200 is fastened. Meanwhile, the remaining two cover attachment members 143 and 144 are respectively disposed on the upstream-side tubular body 121 and the downstream-side tubular body 131, and are each formed as a hook on which the muffler cover 200 is locked.

As illustrated in FIG. 3, the muffler stay 145 is provided on the downstream-side tubular body 131 so as to extend upward at a substantially central position in the front-rear direction of the muffler 36, and is fastened and fixed, with a fastening member 202 (see FIG. 2), to the step holder 46 located on the right side of the vehicle body. As illustrated in FIG. 3, the stay 146 being the stand stopper is provided at the front end of the upstream-side tubular body 121 and inside the upstream-side tubular body in the vehicle widthwise direction.

The upstream-side tubular body 121 of the muffler 36 is formed of an exhaust pipe connection part 122 being connected to the exhaust pipe 35; an inlet pipe 124 extending rearward from the exhaust pipe connection part 122; and a substantially truncated conical tubular portion 126 constituting an outer circumferential member of the upstream-side tubular body 121. As illustrated in FIG. 6, the tubular portion 126 is formed by rolling a metal plate member, for example, a stainless steel plate in the present configuration, so that it may form a substantially truncated conical outer circumferential surface, and has a front end portion 126A formed in the shape of a tube extending along the outer circumference of the inlet pipe 124. The inlet pipe 124 is inserted into the tubular front end portion 126A, and the inlet pipe 124 and the exhaust pipe connection part 122 are joined to this front end portion by welding (a welded location is indicated by reference sign GA in FIG. 6).

The rear end of the inlet pipe 124 being the downstream end thereof is open inside the tubular portion 126 and configured to discharge exhaust gas from the exhaust pipe 35 to the inside of the tubular portion 126. At a lower part of the front end of the tubular portion 126, a hole portion 126B (see FIGS. 3 and 4) serving as a drain hole to drain water inside the tubular portion is formed.

The downstream-side tubular body 131 has a sectional shape longer in the vertical direction than in a horizontal direction parallel with the vehicle widthwise direction (a substantially pentagonal shape (see FIG. 5)), and is formed in a tubular body extending along the central axis C1 of the muffler 36. Inside the downstream-side tubular body 131, multiple (two in the present configuration) separators 151 and 153 are spaced from each other in the front-rear direction, and a rear-end opening of the downstream-side tubular body 131 is closed by a body end member 155.

The downstream-side tubular body 131 is formed in a double-pipe structure where an inner tube 135 constituting an inner circumferential member of the downstream-side tubular body 131 is disposed inside an outer tube 133 constituting an outer circumferential member of the downstream-side tubular body 131. A space R0 between the outer tube 133 and the inner tube 135 is filled with glass wool 137 being a noise-damping material.

The outer tube 133 and the inner tube 135 are each made of a sufficiently rigid and heat-resisting metal plate member, and made of a stainless steel plate member in this embodiment.

The outer tube 133 is a tubular body having a given sectional shape (a substantially pentagonal shape in this embodiment) and extending along the central axis C1 of the downstream-side tubular body 131. The front end (upstream-side end part) of the outer tube is joined to the rear end of the upstream-side tubular body 121 by welding, and a tail cap 141 is mounted to the rear end (downstream-side end part) of the outer tube.

The inner tube 135 is formed in a tubular body having a sectional shape similar to the outer tube 133 and extending along the central axis C1 with the outer tube 133. The inner tube is positioned on the inner circumferential surface of the outer tube 133 by fitting a front end part of the inner tube to the inner circumferential surface of the outer tube 133 with a spacer 136 interposed therebetween, and is restricted from moving ahead of the glass wool 137 by the spacer 136.

Figure 7:
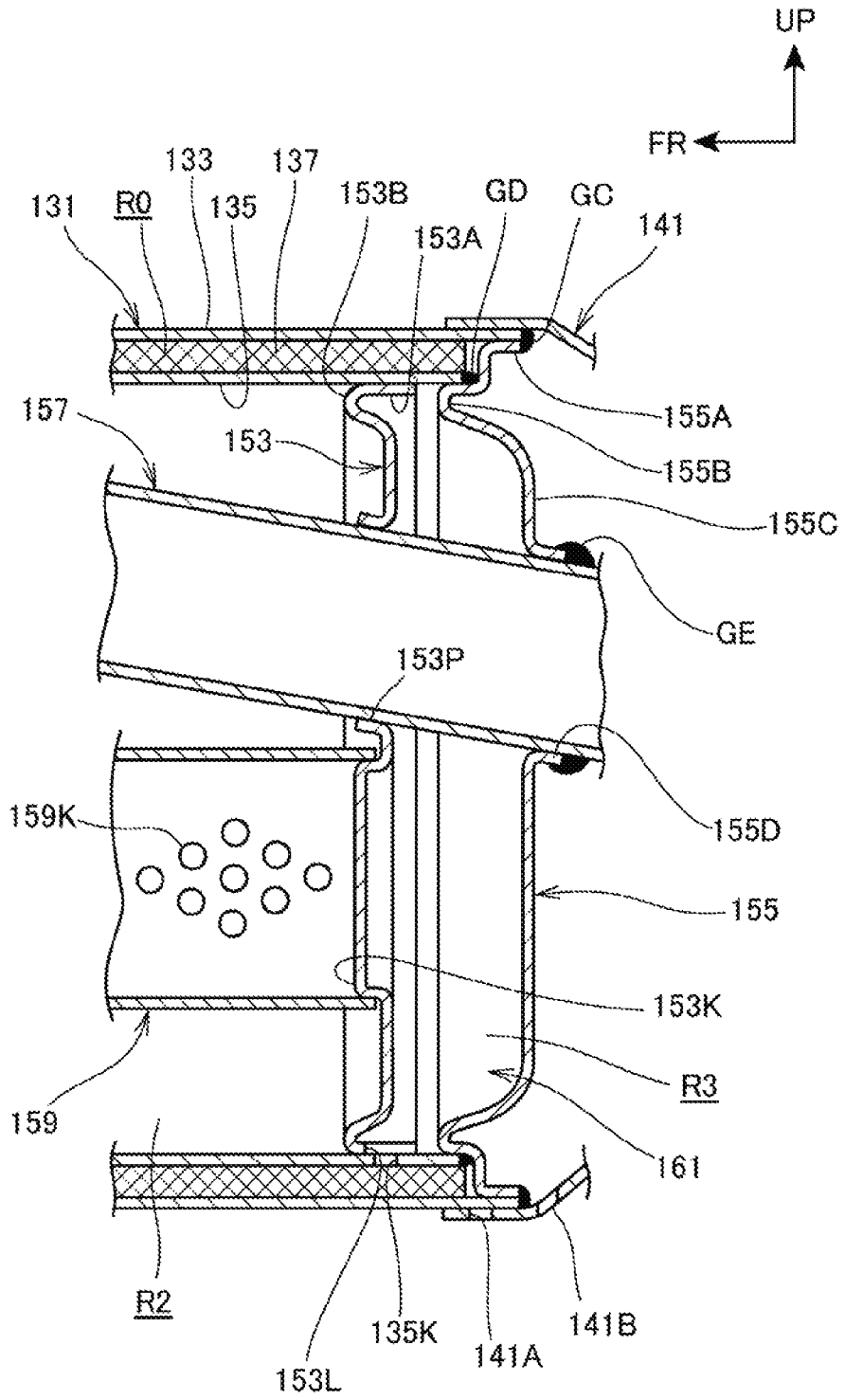
FIG. 7 is a sectional view of a rear part of the muffler.
Figure 8:
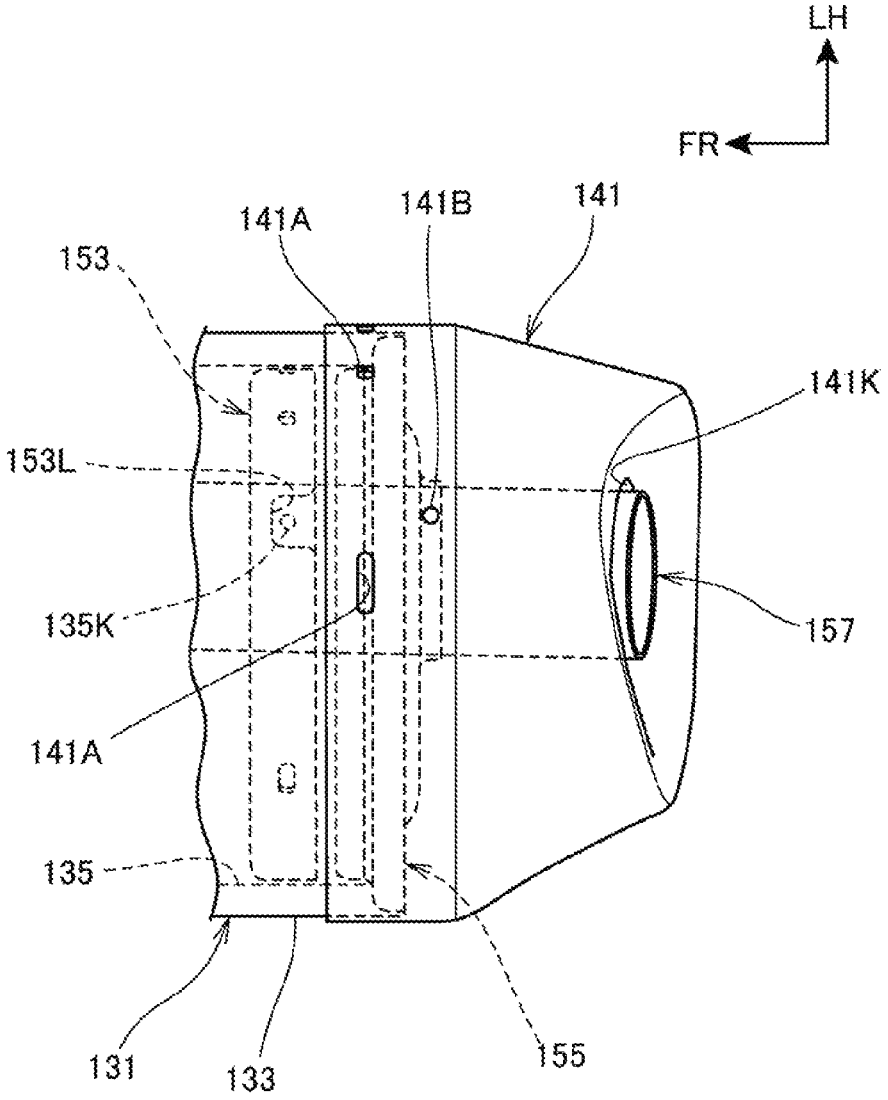
FIG. 8 is a view of the rear part of the muffler in FIG. 7 viewed from the bottom.

FIG. 7 is a sectional view of a rear part of the muffler 36 being a most downstream part of the muffler. FIG. 8 is a view of the rear part of the muffler in FIG. 7 viewed from the bottom. It may be noted that in FIGS. 7 and 8, the front direction of the muffler 36 is indicated by reference sign FR, the upper direction of the muffler 36 is indicated by reference sign UP, and a left direction of the muffler 36 is indicated by reference sign LH.

The body end member 155 is a plate member covering a rear-end opening of the outer tube 133. The body end member 155 has an outer circumferential edge formed as a surface-following portion 155A extending rearward (toward the rear of the vehicle body), which is a downstream side, along the inner circumferential surface of the outer tube 133, and has a curve portion 155B formed so as to extend to an inner circumferential side from the front end (upstream end) of the surface-following portion 155A and then curve such that it projects forward (toward the front of the vehicle body) which is an upstream side.

As illustrated in FIG. 7, the surface-following portion 155A of the body end member 155 serves as a fitting portion to be fitted to the outer tube 133, and the rear end of the outer tube 133 is covered with the body end member 155 by fitting the surface-following portion to the outer tube.

As illustrated in FIG. 7, the curve portion 155B of the body end member 155 serves as a fitting portion to be fitted to the inner circumferential surface of the inner tube 135 when the surface-following portion 155A is fitted to the outer tube 133. The fitting of the body end member 155 to the outer tube 133 and the inner tube 135 allows the body end member 155, the outer tube 133, and the inner tube 135 to be positioned easily, and also allows the space R0 between the outer tube 133 and the inner tube 135 to be reliably closed by the body end member 155.

Thereby, the space R0 between the outer tube 133 and the inner tube 135 extends to the body end member 155, making it possible to fill the space with the glass wool 137 so that it reaches the body end member 155 being the most downstream part of the muffler 36. In addition, since the body end member 155 has the shape of a curve such that parts thereof to be fitted to the outer tube 133 and the inner tube 135 curve, the body end has a modulus of section higher than one having the shape of a flat plate, so that the strength of the body end member 155 can be increased efficiently.

It may be noted that the surface-following portion 155A constituting the outer circumferential edge of the body end member 155 is joined to the outer tube 133 by welding (a welded location is indicated by reference sign GC in FIG. 7), and the curve portion 155B of the body end member 155 and the inner tube 135 are also joined together by welding (a welded location is indicated by reference sign GD in FIG. 7).

In addition, the tail cap 141 is joined to the outer tube 133 by plug welding. More specifically, through holes 141A and 141B (see FIG. 7) are spaced from each other in the front-rear direction in a front part of the tail cap 141. The front-side through holes 141A are spaced from each other in a circumferential direction of the muffler 36 in an area overlapping the outer tube 133, and are each formed in a slotted hole (plug) extending in the circumferential direction of the muffler 36, as illustrated in FIG. 8. The tail cap 141 is plug-welded to the outer tube 133 using these multiple slotted holes (through holes 141A).

Meanwhile, the rear-side through hole 141B (see FIG. 7) is provided in a front lower part of the tail cap 141 at a position behind the outer tube 133, and serves as a drain hole to drain water inside the tail cap 141.

As illustrated in FIGS. 3 and 7, the space R0 between the outer tube 133 and the inner tube 135 is entirely filled with the glass wool 137. Thereby, it is possible to fill the space with the glass wool 137 so that it extends over the entire length of the downstream-side tubular body 131, and thus to secure the noise-damping performance of the muffler 36 easily and suppress a temperature increase of the outer tube 133 using the thermal insulation performance of the glass wool 137.

Further, a part of the body end member 155 inward of the curve portion 155B is formed as a bulging portion 155C bulging toward the rear, which is the downstream side, and a tail pipe 157 penetrates a through hole 155D provided in the bulging portion 155C. The body end member 155 and the tail pipe 157 are joined together by welding an end part of the through hole 155D and the tail pipe 157 to each other (a welded location is indicated by reference sign GE in FIG. 7).

The tail pipe 157 is disposed above the central axis C1 of the muffler 36, i.e., on the opposite side of the central axis from a communicating pipe 159 (see FIGS. 3 and 7) while being offset from the central axis, and is disposed tilting downward toward the rear with respect to the central axis C1. As illustrated in FIG. 3, the tail pipe 157 extends toward the front, which is the upstream side, penetrates the second separator 153 being the most downstream side separator of the multiple separators 151 and 153, and then opens in a space between the separators 151 and 153 (a second expansion chamber R2 to be described later). The tail pipe 157 also extends toward the rear, which is the downstream side, and is exposed to the outside through an opening 141K bored in the tail cap 141.

As illustrated in FIG. 7, the tail pipe 157 is not welded to the second separator 153. In other words, out of the members that the tail pipe 157 penetrates, i.e., the body end member 155 and the second separator 153, the tail pipe is welded only to the body end member 155 being one of the members (a welded location is indicated by reference sign GE in FIG. 7) and is merely inserted into and supported by the second separator 153 being the other member.

Such a tail pipe supporting structure makes it possible to prevent thermal contraction of the tail pipe 157 from affecting both the body end member 155 and the second separator 153, and thereby keep a proper distance between the body end member 155 and the second separator 153.

As illustrated in FIG. 3, the separators 151 and 153 include the first separator 151 provided at a substantially middle part of the downstream-side tubular body 131 in the front-rear direction; and the second separator 153 provided at a rear part of the downstream-side tubular body 131, and this pair of front and rear separators 151 and 153 partitions the muffler 36 into a first expansion chamber R1 and the second expansion chamber R2.

The communicating pipe 159 through which the first expansion chamber R1 and the second expansion chamber R2 communicate with each other penetrates the first separator 151. The communicating pipe 159 opens at its front end inside the first expansion chamber R1, extends rearward toward the second separator 153, and is fitted at its rear end to a fit portion 153K (see FIG. 7) provided in the second separator 153.

As illustrated in FIG. 3, the first separator 151 is formed in the shape of a curve gently curving toward the front, which is the upstream side, has an outer circumferential edge formed as a surface-following portion 151A extending rearward (toward the rear of the vehicle body) along the inner circumferential surface of the inner tube 135, and is positioned on the inner tube 135 by fitting the surface-following portion 151A to the inner tube 135.

As illustrated in FIG. 7, the second separator 153 has: a surface-following portion 153A formed so that the outer circumferential edge of the second separator extends rearward (toward the rear of the vehicle body) along the inner circumferential surface of the inner tube 135; and a curve portion 153B formed so as to curve such that it projects forward (toward the front of the vehicle body) from the front end (upstream end) of the surface-following portion 153A, and is positioned on the inner tube 135 by fitting the surface-following portion 153A to the inner tube 135. Further, since the curve portion 153B continues to the front end of the surface-following portion 153A, it is possible to increase the strength of a part of the second separator 153 to be fitted to the inner tube 135 more than the second separator having the shape of a flat plate.

A notch portion 153L (see FIGS. 7 and 8) being recessed forward is provided at a lower part of the surface-following portion 153A of the second separator 153. The notch portion 153L is formed in a shape being notched so as to avoid a through hole 135K provided in a rear lower part of the inner tube 135, and thus allows the through hole 135K to open in a space R3 (see FIGS. 3 and 7) between the second separator 153 and the body end member 155.

Thereby, moisture, such as dew condensation water, generated in the space R3 between the second separator 153 and the body end member 155 can be drained to the space R0 between the outer tube 133 and the inner tube 135 through the through hole 135K without being blocked by the surface-following portion 153A of the second separator 153.

On a side of the second separator 153 inward of the curve portion 153B, a through hole 153P that the tail pipe 157 penetrates, and the fit portion 153K projecting forward so as to allow the communicating pipe 159 to be fitted thereto are arranged.

A rear-end opening of the communicating pipe 159 is closed by the fit portion 153K of the second separator 153. Multiple through holes 159K radially penetrating the communicating pipe 159 are formed in a rear part of the side surface of the communicating pipe 159. The through holes 159K are arranged in the second expansion chamber R2 being the space between the first separator 151 and the second separator 153, thus enabling exhaust gas having entered the communicating pipe 159 from the first expansion chamber R1 to be flowed into the second expansion chamber R2 through the through holes 159K of the communicating pipe 159.

With the muffler structure described above, exhaust gas discharged from the engine 10 enters the first expansion chamber R1 in the muffler 36 through the exhaust pipe 35 and the inlet pipe 124 and enters the second expansion chamber R2 through the communicating pipe 159, then enters the tail pipe 157 with its flow direction inverted, and is then discharged to the outside of the muffler 36 through the tail pipe 157. Such a multiple number of times of expansion and inversion of flow enable a reduction in exhaust pressure and exhaust sound.

Figures 9A, 9B, 9C, 9D:
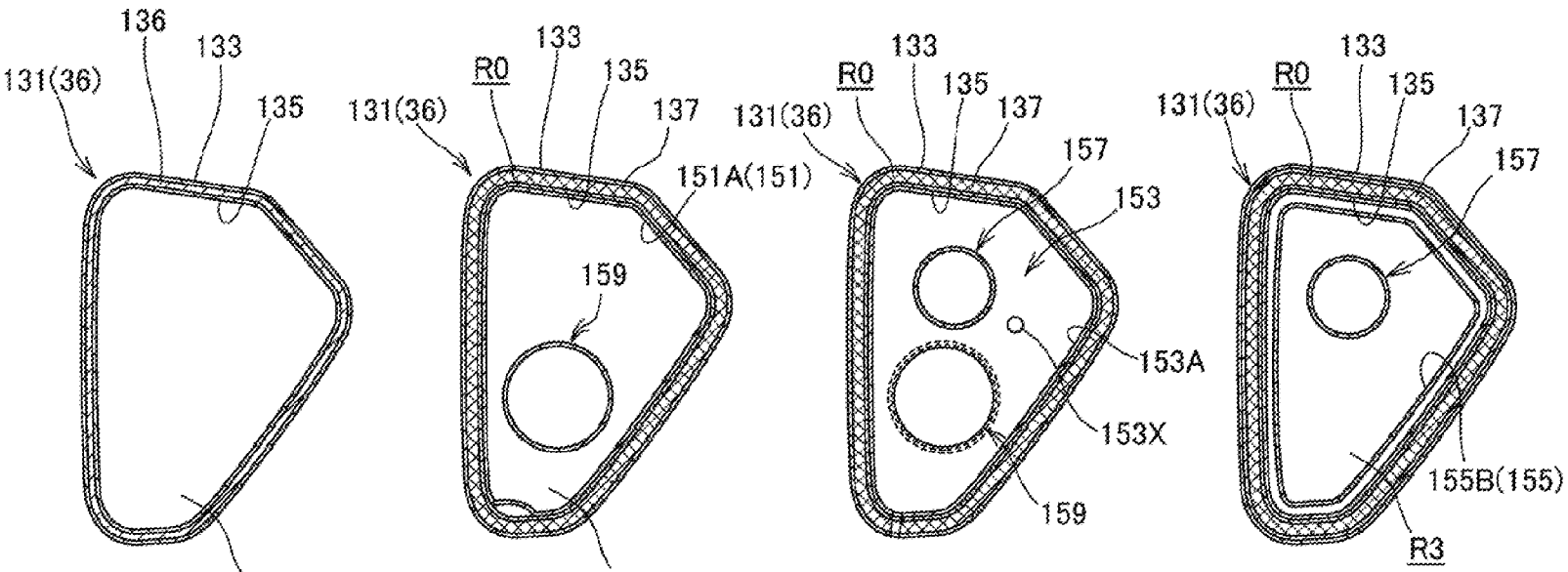

FIGS. 9A to 9D are each a sectional view of the muffler 36, in which FIG. 9A is a sectional view taken along a line A-A in FIG. 3, FIG. 9B is a sectional view taken along a line B-B in FIG. 3, FIG. 9C is a sectional view taken along a line C-C in FIG. 3, and FIG. 9D is a sectional view taken along a line D-D in FIG. 3.

As illustrated in FIG. 9A, at a front part of the downstream-side tubular body 131, the spacer 136 is disposed between the outer tube 133 and the inner tube 135. As illustrated in FIG. 9B, the communicating pipe 159 has a cylindrical shape and is disposed at a lower part of the downstream-side tubular body 131 while being offset therefrom. As illustrated in FIGS. 9C and 9D, the tail pipe 157 is disposed at an upper part of the downstream-side tubular body 131 while being offset therefrom. Thereby, the tail pipe 157 and the communicating pipe 159 are respectively disposed on the upper and lower sides of the downstream-side tubular body. Such configuration makes it possible to layout the tail pipe 157 and the communicating pipe 159 while effectively utilizing the space inside the muffler 36 whose horizontal length is shorter than its vertical length.

Further, in the present configuration, the tail pipe 157 is disposed tilting with respect to the central axis C1 of the muffler 36, as illustrated in FIG. 7. Thus, it is possible to easily adjust the position and orientation of an exhaust port of the tail pipe 157 by adjusting the tilt angle of the tail pipe 157. The tail pipe 157 has a smaller diameter than the communicating pipe 159 and is shorter than the communicating pipe 159. In other words, the tail pipe 157 is a lighter component than the communicating pipe 159.

In the present configuration, the relatively light tail pipe 157 is disposed above the relatively heavy communicating pipe 159. This lowers the position of the center of gravity of the muffler 36 and facilitates arrangement of these pipes in the narrow muffler 36. In this way, the tail pipe 157 and the communicating pipe 159 are efficiently disposed in the muffler 36 having limited layout space.

Further, in the present configuration, the space R3 between the body end member 155 and the second separator 153 of the muffler 36 is defined as a resonator chamber (hereinafter described as a "resonator chamber R3"), and a communicating port 153X (see FIG. 9C) through which the resonator chamber R3 and the second expansion chamber R2 communicate with each other is bored in the second separator 153. Thereby, a resonator 161 for exhaust sound reduction is formed at the most downstream part of the muffler 36. It may be noted that the a communicating port 153X is provided at a position between the tail pipe 157 and the communicating pipe 159, which are spaced from each other in the vertical direction, and outside these pipes in the vehicle widthwise direction. As shown, the resonator chamber R3 has a relatively small volume which may be less than half of the volume of either of the expansion chambers R1, R2, and that the communicating port 153X has a relatively small size or diameter which may be less than half of the internal diameters of the communication pipe 159 and the tail pipe 157.

The resonator 161 is configured to reduce exhaust sound by use of the Helmholtz resonance principle, and is capable of reducing exhaust sound efficiently by adjusting the resonant frequency of the resonator chamber R3. The resonant frequency can be adjusted by adjusting the volume of the resonator chamber R3. Besides, not only the reduction in the volume of exhaust sound but also the tone control of exhaust sound can be implemented by adjusting the resonant frequency appropriately.

Here, the second separator 153 includes the curve portion 153B curving so as to project forward, as illustrated in FIG. 7. Thus, by adjusting the curve shape of the curve portion 153B, the volume of the resonator chamber R3 can be easily adjusted without a change in the position of the body end member 155 or the second separator 153.

For example, the volume of the resonator chamber R3 can be adjusted by adjusting appropriately the curvature of and the amount of projection in the front-rear direction of the curve portion 153B of the second separator 153.

It may be noted that the method of adjusting the volume of the resonator chamber R3 is not limited to the method of adjusting the shape of the curve portion 153B of the second separator 153. For example, the shape of the curve portion 155B of the body end member 155 or the like may be adjusted, and a clearance between the body end member 155 and the second separator 153 may be adjusted.

In addition, since the resonator chamber R3 is provided using a space between the body end member 155 and the second separator 153, a size increase of the muffler 36 can be suppressed. Accordingly, such configuration is favorable for a reduction in length in the front-rear direction of the muffler 36 equipped with the resonator 161 without a size increase of the muffler, and is thus suitable when a muffler with a short length in the front-rear direction is requested in terms of mass centralization of the vehicle body, design quality, output characteristics, noise, fuel consumption, and the like.

Moreover, since the temperature of the resonator chamber R3 is lower than those of the first expansion chamber R1 and the second expansion chamber R2 being the chambers other than the resonator chamber in the muffler 36, it is possible to reduce uneven burns on the most downstream part of the muffler due to the influence of exhaust heat.

Additionally, since the glass wool 137 is disposed so that it reaches the vicinity of the body end member 155, the resonator chamber R3 can be surrounded by the glass wool 137. This makes it possible to further reduce uneven burns in areas around the resonator 161 due to the influence of exhaust heat. Moreover, since the glass wool 137 also serves as a noise-damping material, it is possible to suppress leakage of sound, such as exhaust sound, through areas around the resonator chamber R3. Accordingly, it is possible to take measures against exhaust heat and exhaust sound in areas around the resonator 161 by efficiently using the glass wool 137 between the outer tube 133 and the inner tube 135.

Further, since a rear end part of the outer tube 133 has a double-wall structure formed of the body end member 155 and the second separator 153, unwanted sound due to resonance and the like can be reduced more than one having a single-wall structure, and measures against noise can be taken effectively by synergy with the glass wool 137 disposed around the rear end part.

In particular, because the motorcycle 1 has a configuration of one resonator chamber R3, exhaust heat, exhaust sound, and the like are more likely to be transmitted to the resonator chamber R3 than one having two resonator chambers; however, according to the present muffler configuration, it is possible to take measures against exhaust heat and noise of the resonator 161 with a simple configuration.

Figure 10A:
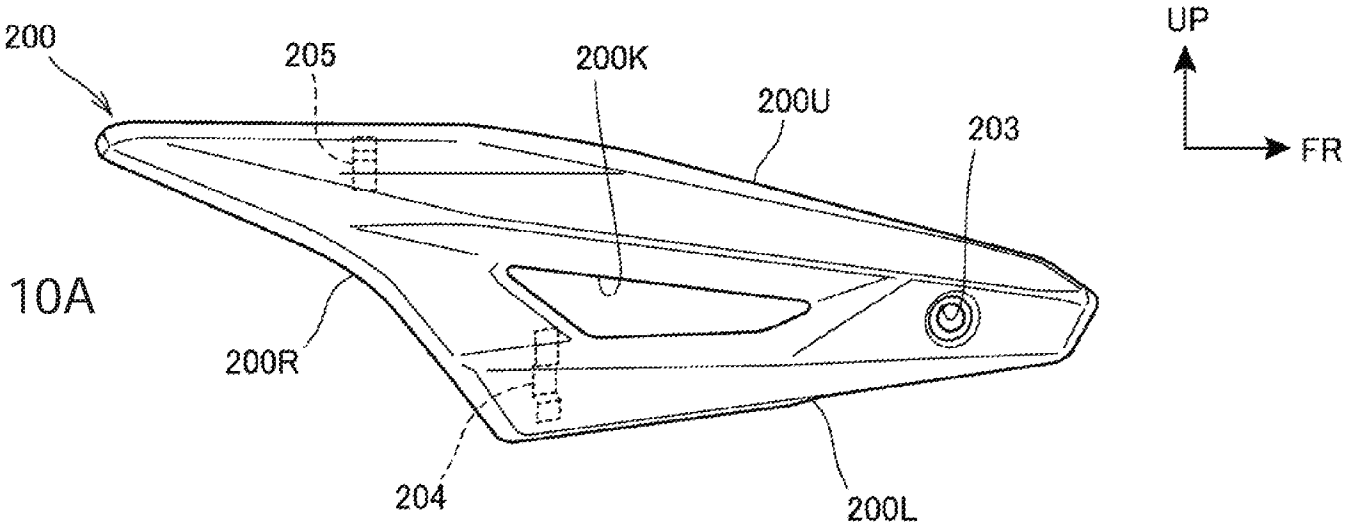
Figure 10B:
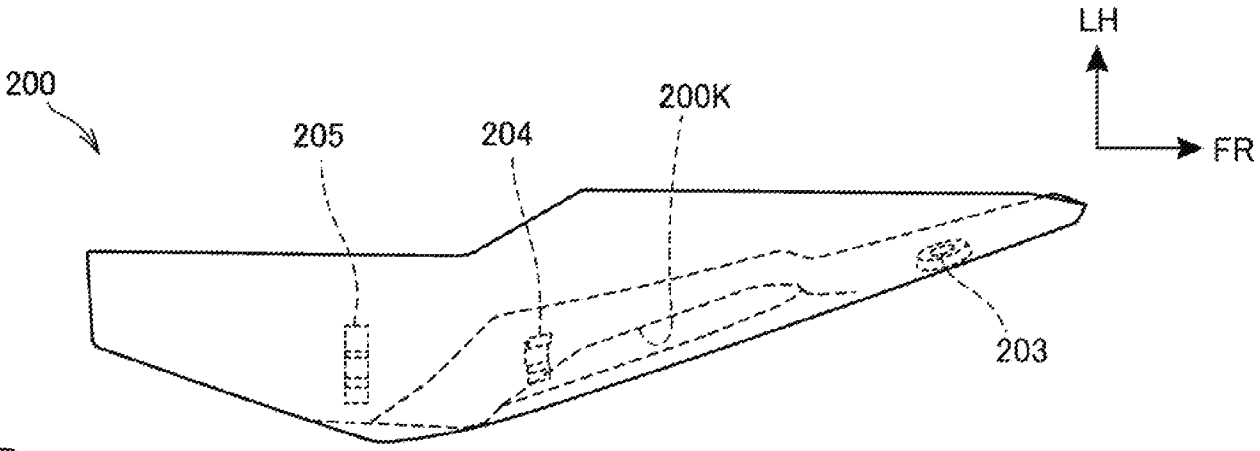

FIGS. 10A and 10B are each a view of the muffler cover 200, in which FIG. 10A is a view of the muffler cover 200 viewed from the right side of the vehicle body, and FIG. 10B is a top view of the muffler cover 200. it may be noted that in FIGS. 10A-10B, a front direction of the muffler cover 200 is indicated by reference sign FR, an upper direction of the muffler cover 200 is indicated by reference sign UP, and a left direction of the muffler cover 200 indicated by reference sign LH.

The muffler cover 200 is a plate-shaped member made of synthetic resin that covers the muffler 36 over an area from an upper side to a right lateral side thereof. A fastening hole portion 203 through which to insert the fastening member 201 (see FIG. 2) to be fastened to the cover attachment member 142 (see FIG. 4) attached to the muffler 36 is formed at a front part of the muffler cover 200, and to-be-locked portions 204 and 205 in which the cover attachment members 143 and 144 (see FIG. 3) provided in the muffler 36 are locked are arranged on the inner side of a rear part of the muffler cover 200. With these portions, the muffler cover 200 is fixed to the muffler 36.

In a side view of the vehicle body, the muffler cover 200 is formed in the shape of a triangle (in a side view) expanding vertically from the front toward the rear. More specifically, the muffler cover 200 has the shape of a triangle (in a side view) including an upper edge 200U extending upward toward the rear from the front end thereof; a lower edge 200L extending downward toward the rear from the front end thereof; and a rear edge 200R connecting the rear end of the lower edge 200L and the rear end of the upper edge 200U. The rear edge 200R is formed so as to be lower in front by extending the upper edge 200U rearward of the lower edge 200L.

Thereby, the muffler cover 200 has such a shape that its rear lower part is cut along the lower-in-front rear edge 200R and, as illustrated in FIG. 2, the muffler cover is formed so as not to cover areas overlapping the tail pipe 157, the communicating pipe 159, the pair of front and rear separators 151 and 153, the body end member 155, and the tail cap 141 in a side view.

With the muffler cover structure described above, the muffler cover 200 has a compact design centering on the center of the vehicle body in the front-rear direction and the center of gravity of the muffler cover 200 is located close to the front, which is favorable for mass centralization of the vehicle. In addition, heat between the muffler 36 and the muffler cover 200 can be discharged toward the rear smoothly by a traveling wind coming from the front side of the vehicle body, thus making heat less likely to be retained between them.

Further, as illustrated in FIGS. 10A-10B, the muffler cover 200 is provided with a cover opening 200K that is open at a substantially middle part thereof in the front-rear and vertical directions. The cover opening 200K also allows heat between the muffler 36 and the muffler cover 200 to be discharged efficiently.

As illustrated in FIG. 2, the cover opening 200K is provided in an area overlapping a downstream-side part of the inlet pipe 124 in a side view. This makes it possible to efficiently discharge heat around the inlet pipe 124 which is likely to increase in temperature among the parts in the muffler 36. Meanwhile, since an upper part of the muffler cover 200 is formed in a shape extending long from the vicinity of the step 47 for the rider to the vicinity of the tandem step 48 for the passenger, it is possible to effectively avoid a situation where heat from the muffler 36 is transmitted toward the steps 47 and 48.

As has been described above, according to this embodiment, as illustrated in FIG. 7, the resonator chamber R3 is provided in the most downstream part of the muffler 36 by: the outer tube 133 constituting an outer circumferential member of the muffler 36; the body end member 155 provided at the downstream end of the outer tube 133; and the second separator 153 being the closest to the body end member 155, and the surroundings of the resonator chamber R3 are surrounded by the glass wool 137 which is a noise-damping material. Thus, by using the resonator chamber R3 lower in temperature than the first and second expansion chambers R1 and R2 in the muffler 36 and the glass wool 137 around the resonator chamber R3, it is possible to reduce uneven burns on the most downstream part of the muffler where uneven burns are generally likely to occur, and reduce exhaust sound.

Moreover, since the rear end part of the outer tube 133 being a downstream part thereof has a double-wall structure formed of the body end member 155 and the second separator 153, unwanted sound at the most downstream part of the muffler can be reduced. Accordingly, it is possible to take measures against exhaust heat and exhaust sound even with a configuration where there is only one resonator chamber R3.

In addition, the space between the outer tube 133 and the inner tube 135 is filled with the glass wool 137, and the through hole 135K being a water-draining opening is provided in the inner tube 135 at a position under the resonator chamber R3. Thus, moisture pooled in the resonator chamber R3 can be drained to the space R0 of the glass wool 137 between the outer tube 133 and the inner tube 135. Thereby, it is possible to avoid a situation where beads of water run on a lower surface of the muffler 36 at a position immediately below the resonator chamber R3.

Besides, the second separator 153 being the closest separator to the body end member 155 includes the curve portion 153B curving toward the front of the vehicle body; and the surface-following portion 153A extending toward the rear of the vehicle body along the inner tube 135, and the surface-following portion 153A is provided with the notch portion 153L exposing the through hole 135K provided in the inner tube 135. Thus, the notch portion 153L allows moisture pooled in the resonator chamber R3 to enter the through hole 135K of the inner tube 135 to be drained to the space R0 of the glass wool 137 without being blocked by the surface-following portion 153A of the second separator 153. Moreover, the volume of the resonator chamber R3 can be easily adjusted by the curve portion 153B of the second separator 153.

Further, the body end member 155 includes the curve portion 155B curving toward the front of the vehicle body, and the curve portion 155B is fitted to the inner tube 135 and covers the glass wool 137 in the space between the outer tube 133 and the inner tube 135. Thus, it is possible to use the body end member 155 as a lid member covering the glass wool 137, and fill the space with the glass wool 137 so that it reaches the vicinity of the body end member 155. Accordingly, the surroundings of the resonator chamber R3 can be extensively covered with the glass wool 137.

Moreover, the tail pipe 157 is welded to the body end member 155, and is inserted into and supported by the second separator 153. Thus, it is possible to stably support the tail pipe 157 and improve the workability in attachment of the tail pipe 157 as compared to the case where the tail pipe 157 is supported by only one of the body end member 155 and the second separator 153. Besides, it is also possible to prevent thermal expansion or thermal contraction of the tail pipe 157 from affecting both the body end member 155 and the second separator 153.

Furthermore, the muffler 36 includes the communicating pipe 159 disposed inside it and configured to emit exhaust gas from the exhaust pipe 35 to the second expansion chamber R2 defined by the second separator 153, and the tail pipe 157 is disposed with a tilt above the communicating pipe 159. Thereby, it is possible to dispose the communicating pipe 159 and the tail pipe 157 efficiently using upper and lower spaces in the muffler 36.

Moreover, as illustrated in FIG. 2, the downstream end of the muffler 36 is located ahead of the rear end of the swing arm 12, and the muffler cover 200 is provided in the muffler 36 at a position not overlapping the tail pipe 157 and the communicating pipe 159 in a side view. Thereby, it is possible to achieve a muffler cover shape less likely to retain heat from the muffler 36 while maintaining design quality.

The above embodiment is merely one mode of the present invention, and any modifications and variations are possible without departing from the gist of the present invention.

For example, although the above embodiment describes the case where the two separators 151 and 153 are provided in the muffler 36, the number of separators may be one or more than three. In other words, the present invention is applicable to mufflers having one or multiple separators. In addition, although the above embodiment describes the case where the glass wool 137 is used as a noise-damping material, noise-damping materials other than glass wool may be used.

Further, the above embodiment describes the case where the present invention is applied to the exhaust structure of the motorcycle 1 illustrated in FIG. 1. However, not limited thereto, the present invention may be applied to the exhaust structure of any of other publicly-known straddle-type vehicles. Note that the straddle-type vehicles encompass all kinds of vehicles on which a rider rides by straddling a vehicle body, and includes not only motorcycles (including motor bicycles) but also three-wheeled vehicles and four-wheeled vehicles such as all terrain vehicles (ATVs).

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

DESCRIPTION OF REFERENCE NUMERALS

1 MOTORCYCLE (STRADDLE-TYPE VEHICLE)
F BODY FRAME
12 SWING ARM
14 HEAD PIPE
35 EXHAUST PIPE
36 MUFFLER
133 OUTER TUBE
135 INNER TUBE
135K THROUGH HOLE (WATER-DRAINING OPENING)
137 GLASS WOOL
151 FIRST SEPARATOR
153 SECOND SEPARATOR
153A SURFACE-FOLLOWING PORTION

153B CURVE PORTION
153L NOTCH PORTION
155 BODY END MEMBER
157 TAIL PIPE
159 COMMUNICATING PIPE
161 RESONATOR
200 MUFFLER COVER
R1 FIRST EXPANSION CHAMBER
R2 SECOND EXPANSION CHAMBER
R3 RESONATOR CHAMBER.

What is claimed is:

1. An exhaust structure of a straddle-type vehicle including an engine; said exhaust structure comprising:
an exhaust pipe which extends from the engine; and
a muffler connected to said exhaust pipe so as to receive exhaust gas discharged from the engine;
wherein said muffler comprises:
an outer tube which constitutes an outer circumferential member of said muffler;
first and second separators arranged in and defining expansion chambers in said outer tube, the second separator being disposed downstream of the first separator;
a body end member provided at a downstream end of said outer tube;
a noise-damping material provided on an inner circumference of said outer tube; and
a resonator chamber provided in a downstream most portion of said outer tube which reduces exhaust sound of exhaust gas discharged from the engine; wherein
said resonator chamber is formed by said outer tube, said body end member, and said second separator;
the resonator chamber only communicates with one of the expansion chambers; and
surroundings of said resonator chamber are surrounded by said noise-damping material.

2. The exhaust structure of a straddle-type vehicle according to claim 1, wherein said muffler further comprises an inner tube provided inside said outer tube;
wherein a space between said inner tube and said outer tube is filled with said noise-damping material; and
wherein said inner tube has a water-draining opening formed therein at a position located below said resonator chamber.

3. The exhaust structure of a straddle-type vehicle according to claim 2, wherein said second separator is located at a position closest to said body end member; and said second separator includes:
a curve portion which curves in an upstream direction of the exhaust structure; and
a surface-following portion which extends in a downstream direction of the exhaust structure along said inner tube;
said surface-following portion having a notch portion which exposes said water-draining opening of said inner tube.

4. The exhaust structure of a straddle-type vehicle according to claim 1, wherein
said muffler further comprises
a tail pipe which penetrates said body end member and said second separator located closest to said body end member, said tail pipe being configured to emit said exhaust gas to outside air; and
wherein said tail pipe is welded to said body end member, and is inserted into and supported by said second separator.

5. The exhaust structure of a straddle-type vehicle according to claim 4, wherein
said tail pipe provides a communication passage between one of said expansion chambers located closest to said body end member and outside of said muffler.

6. The exhaust structure of a straddle-type vehicle according to claim 5, wherein
said muffler further comprises
a communication pipe which penetrates said first separator and provides a communication passage between said one expansion chamber located closest to said body end member and another expansion chamber on an opposite side of the first separator.

7. The exhaust structure of a straddle-type vehicle according to claim 6, wherein the resonator chamber only communicates with said one expansion chamber located closest to said body end member.

8. The exhaust structure of a straddle-type vehicle according to claim 1, wherein:
said straddle-type vehicle further comprises a communication pipe which penetrates said first separator and provides a communication passage between said expansion chambers, a swing arm and a muffler cover;
a downstream end of said muffler is located forward of a rear end of said swing arm; and
the muffler cover is provided in said muffler at a position covering part of the muffler without overlapping said tail pipe and said communicating pipe when viewed in a side view.

9. A straddle-type vehicle comprising:
an engine;
an exhaust pipe extending from the engine; and
a muffler connected to said exhaust pipe;
wherein said muffler comprises:
an outer tube;
a noise-damping material provided on an inner circumference of said outer tube;
a body end member provided at a downstream end of said outer tube;
a first separator and a second separator disposed in said outer tube and define expansion chambers in said outer tube, said second separator being disposed between the first separator and the body end member; and
a communication pipe which penetrates said first separator and provides a communication passage between said expansion chambers;
wherein:
said second separator and said body end member define a resonator chamber in a downstream portion of said outer tube;
a circumferential portion of said resonator chamber is surrounded by said noise-damping material; and
the resonator chamber only communicates with one of the expansion chambers located closest to said body end member and does so through an opening defined in the second separator, the opening having a diameter which is less than half of an inner diameter of the communication pipe.

10. The vehicle according to claim 9, wherein:
said muffler further comprises an inner tube provided inside said outer tube;
a space between said inner tube and said outer tube is filled with said noise-damping material; and
said inner tube has a water-draining opening formed therein at a position located below said resonator chamber.

11. The vehicle according to claim 10, wherein said second separator has a notch portion which exposes said water-draining opening of said inner tube.

12. The vehicle according to claim 10, wherein said body end member includes a curve portion fitted to said inner tube; and wherein said curve portion covers said noise-damping material in a space between said outer tube and said inner tube.

13. The vehicle according to claim 10, wherein said muffler further comprises a tail pipe which penetrates said body end member and said second separator; wherein said tail pipe provides a communication passage between said one expansion chamber located closest to said body end member and outside of said muffler;

said one expansion chamber located closest to said body end member also communicates with another of said expansion chambers; and said tail pipe is welded to said body end member, and is inserted into and supported by said second separator.

14. A muffler comprising an outer tube;

an inner tube provided inside said outer tube;

a noise-damping material disposed between said outer tube and said inner tube, a body end member provided at a downstream end of said outer tube;

a first separator and a second separator disposed in said outer tube and which define expansion chambers in said muffler;

wherein:

said second separator and said body end member define a resonator chamber in a downstream portion of said outer tube;

a circumferential portion of said resonator chamber is filled with said noise-damping material;

a volume of the resonator chamber is less than half of the volume of any of the expansion chambers; and the resonator chamber only communicates with one of the expansion chambers.

15. The muffler according to claim 14, wherein said inner tube has a water-draining opening formed therein at a position located below said resonator chamber.

16. The muffler according to claim 15, wherein said second separator has a notch portion which exposes said water-draining opening of said inner tube.

17. The muffler according to claim 14, further comprising:

a tail pipe which penetrates said body end member and said second separator; and a communication pipe which penetrates said first separator and provides a communication passage between said expansion chambers;

wherein said tail pipe is welded to said body end member, and is inserted into and supported by said second separator.

18. The exhaust structure of a straddle-type vehicle according to claim 1, wherein said muffler further comprises a communication pipe which penetrates said first separator and provides a communication passage between said expansion chambers.

19. The exhaust structure of a straddle-type vehicle according to claim 18, wherein the resonator chamber only communicates with one of the expansion chambers located closest to said body end member and does so through an opening defined in the second separator, the opening having a diameter which is less than half of an inner diameter of the communication pipe.

20. The exhaust structure of a straddle-type vehicle according to claim 1, wherein a volume of the resonator chamber is less than half of the volume of any of the expansion chambers.

* * * * *